US006517277B2

(12) United States Patent
Hu et al.

(10) Patent No.: US 6,517,277 B2
(45) Date of Patent: Feb. 11, 2003

(54) EXPANSION AND CRACK JOINT COUPLER

(75) Inventors: Kuo-Kuang Hu, Manhattan, KS (US); Philip G. Kirmser, Manhattan, KS (US)

(73) Assignee: Kansas State University Research Foundation, Manhattan, KS (US)

( * ) Notice: Subject to any disclaimer, the term of this patent is extended or adjusted under 35 U.S.C. 154(b) by 0 days.

(21) Appl. No.: 09/843,963

(22) Filed: Apr. 27, 2001

(65) Prior Publication Data

US 2001/0022918 A1 Sep. 20, 2001

Related U.S. Application Data

(63) Continuation of application No. 09/158,397, filed on Sep. 22, 1998.

(51) Int. Cl.[7] ..... E01C 11/14

(52) U.S. Cl. ..... 403/294; 404/59; 404/47; 52/396.02; 52/309.17

(58) Field of Search ..... 404/59, 47; 52/396.02, 52/309.17; 403/294; E01C 11/14

(56) References Cited

U.S. PATENT DOCUMENTS

| | | | | | |
|---|---|---|---|---|---|
| 1,279,431 | A | * | 9/1918 | Poulston | 404/63 |
| 2,149,291 | A | * | 3/1939 | Hofwolt | 404/60 |
| 2,162,467 | A | * | 6/1939 | Brickman et al. | 404/59 |
| 2,186,104 | A | * | 1/1940 | Geyer et al. | 404/60 |
| 2,212,615 | A | * | 8/1940 | Older | 404/59 |
| 2,305,979 | A | * | 12/1942 | Mitchell | 404/59 |
| 2,482,836 | A | * | 9/1949 | Brickman et al. | 404/53 |
| 2,531,040 | A | * | 11/1950 | Heltzel | 404/59 |
| 3,397,626 | A | * | 8/1968 | Kornick et al. | 404/59 |
| 3,437,017 | A | * | 4/1969 | Walz et al. | 404/60 |
| 3,972,640 | A | * | 8/1976 | Miller | 404/62 |
| 4,522,531 | A | * | 6/1985 | Thomsen et al. | 404/2 |
| 5,852,863 | A | * | 12/1998 | Muller et al. | 29/417 |
| 6,171,016 | B1 | * | 1/2001 | Pauls et al. | 404/64 |

FOREIGN PATENT DOCUMENTS

EP 765967 A1 * 4/1997

* cited by examiner

*Primary Examiner*—Lynne H. Browne
*Assistant Examiner*—Ernesto Garcia
(74) *Attorney, Agent, or Firm*—Hovey Williams LLP

(57) ABSTRACT

An expansion or crack joint assembly (32) utilizes a coupler (20) with or without a bottom sheet (34) to join adjacent roadway concrete slabs (86, 90) formed separately initially or continuously cast and later separated by a saw cut, which induces cracking to form a crack joint. The coupler (20) includes a casing (22), an internal component (24,25,62,65), and outer sleeve (26), and end caps (28,30). The casing (22) defines an internal chamber (40) which receives the internal component (24,25,62,65) therein. The sleeve (26) and end caps (28,30) fit over the casing (22). The casing (22) and sleeve (26) transmit loads between the concrete slabs (86,90) while the sleeve (26) and end caps (86,90) operate to reduce stress concentrations. The bottom sheet (34) inhibits water from entering the expansion or crack joint assembly (32) from below, if used, and prevents pumping. In various embodiments, the internal component is a spring disk (24, 25), a flat, circular disk (62), and a structural material (65), such as concrete, which substantially fills the internal chamber (40).

23 Claims, 2 Drawing Sheets

EXPANSION AND CRACK JOINT COUPLER

RELATED APPLICATION

This is a continuation application of application Ser. No. 09/158,397 filed Sep. 22, 1998.

BACKGROUND OF THE INVENTION

1. Field of the Invention

The present invention is broadly concerned with improved, preferably prefabricated expansion or crack joint couplers particularly designed for use in joining concrete roadway slabs in order to properly transfer vertical forces between concrete slabs while minimizing stress concentrations experienced using conventional dowels at expansion or crack joints. More particularly, the invention pertains to an expansion or crack joint coupler including a steel which bridges joints between concrete slabs with the ends of the coupler embedded in the slabs. In preferred forms, substantially circular disks are inserted in the coupler and its ends are closed with end caps with a multifunction reinforcing sleeve centrally positioned around the outside of the coupler. Alternatively or additionally, the coupler is filled with a structural material such as concrete.

Our invention keeps the strength and stiffness of the pavement at a joint equal to that in the middle of a pavement slab to the extent possible, while keeping the tensile stress low in the slab at a joint so that in the normal shrinkage and expansion of pavements, adjacent slabs will separate at the joints instead of by developing cracks in the middle of the slabs. In doing this, the new coupler transfers bending moments as well as shearing forces.

One of the main purposes of this invention is to transfer shear forces and bending moments from the loaded slab to unloaded slab as heavily loaded wheels cross the joints or cracks while keeping the differential deflection between the slabs a minimum, and decreasing the vertical deflection of the slabs at the joints.

2. Description of Prior Art

In the construction of concrete roadways, it is common practice to install expansion or crack joint assemblies at spaced locations, so that the completed roadway can properly expand and contract under varying temperature and environmental conditions. Typical expansion or crack joint assemblies make use of a plurality of laterally spaced apart shear transfer devices having elongated force transmission members.

With the presently used expansion or crack joints the PCC (Portland Cement Concrete) slabs usually deteriorate near the crack joints. This deterioration is caused by excessive compressive or bearing stresses between the concrete and the dowels. These cause powdering of the concrete at the surface of the dowels near the joints between the slabs, which in turn creates voids around the dowels into which moisture and de-icing salt water flow causing serious corrosion of exposed steel. The powdered concrete abrades anti-corrosion coatings, which causes even previously coated dowels to corrode. Compressive stresses caused by heavy wheel loads also cause lateral splitting forces along the dowels, another compressive failure problem.

The bending stiffness of currently used steel dowels and other dowels in experimental stages are not great enough to transfer the moments required by current traffic, or to reduce warping at the corners of the slabs.

At extreme temperatures, the steel dowels can be compressed between the concrete slabs, again causing excessive stress in the concrete, and even deforming the dowel and crushing the concrete at the ends of the dowels.

SUMMARY OF THE INVENTION

The present invention overcomes the problems outlined above and provides an improved expansion or crack joint coupler. By virtue of a unique outer casing defining an internal chamber and having a structural component inserted in the internal chamber, the improved expansion or crack joint coupler provides increased stiffness, strength, and load transferring ability while reducing weight and stress concentrations.

Broadly speaking, the expansion or crack joint coupler of the present invention has a casing with two ends and a central region therebetween. The casing defines an internal chamber and is designed to be embedded in adjacent concrete slabs and to extend across an expansion or crack joint between the slabs. An internal structural component is inserted into the internal chamber to enhance the properties of the casing.

In a preferred embodiment, two tapered spring disks are inserted into the internal chamber of the casing, which is preferably structural steel pipe. The spring disks are positioned approximately equal distances on opposite sides of the casing center, and each spring disk includes a rigid smaller diameter portion and a compressible larger diameter portion which is ring-shaped. The compressible portion of the disk defines a plurality of slits equal spaced around the circumference of the disk, and the compressible portion preferably face outward toward the end of the casing.

In another preferred embodiment, a single solid disk is centrally positioned in the internal chamber. The disk is rigid and preferably fits tightly in the casing chamber.

In still another preferred embodiment, the casing is filled with a structural material. The structural material is preferably concrete, but can be any material with appropriate stiffness.

There is further provided in the practice of the invention a novel outer reinforcing sleeve and a novel pair of end caps. The sleeve is preferably shorter than the casing and is centrally positioned on the casing. The ends of the sleeve are advantageously rounded to reduce stress concentrations, and if a steel sleeve is used, rubber end rings with rounded corners preferably abut the ends of the sleeve. The end caps close the ends of the casing and preferably define an opening receiving the ends of the casing therein. The end caps can also include a plurality of gripping bumps on their outer surface. Both the sleeve and the end caps are preferably formed with a material that is softer than the casing thereby reducing stress concentrations.

There is still further provided in the practice of the invention a novel expansion or crack joint assembly in which two adjacent concrete slabs are positioned to define a narrow gap therebetween. A sheet is positioned beneath the slabs and covers the gap to prevent pumping effects. Preferably, the coupler described above is embedded in the concrete slabs and extends across the expansion or crack joint.

The invention can be used to connect slabs having expansion joints provided for beforehand; or for those which are cast continuously and then caused to crack at predetermined places (where the couplers are placed before casting) by the use of saw cuts made in the pavement at the proper time after casting the continuous pavement. The invention can be used for expansion joints of concrete structures other than pavements.

DETAILED DESCRIPTION OF THE PREFERRED EMBODIMENTS

Figure 1:
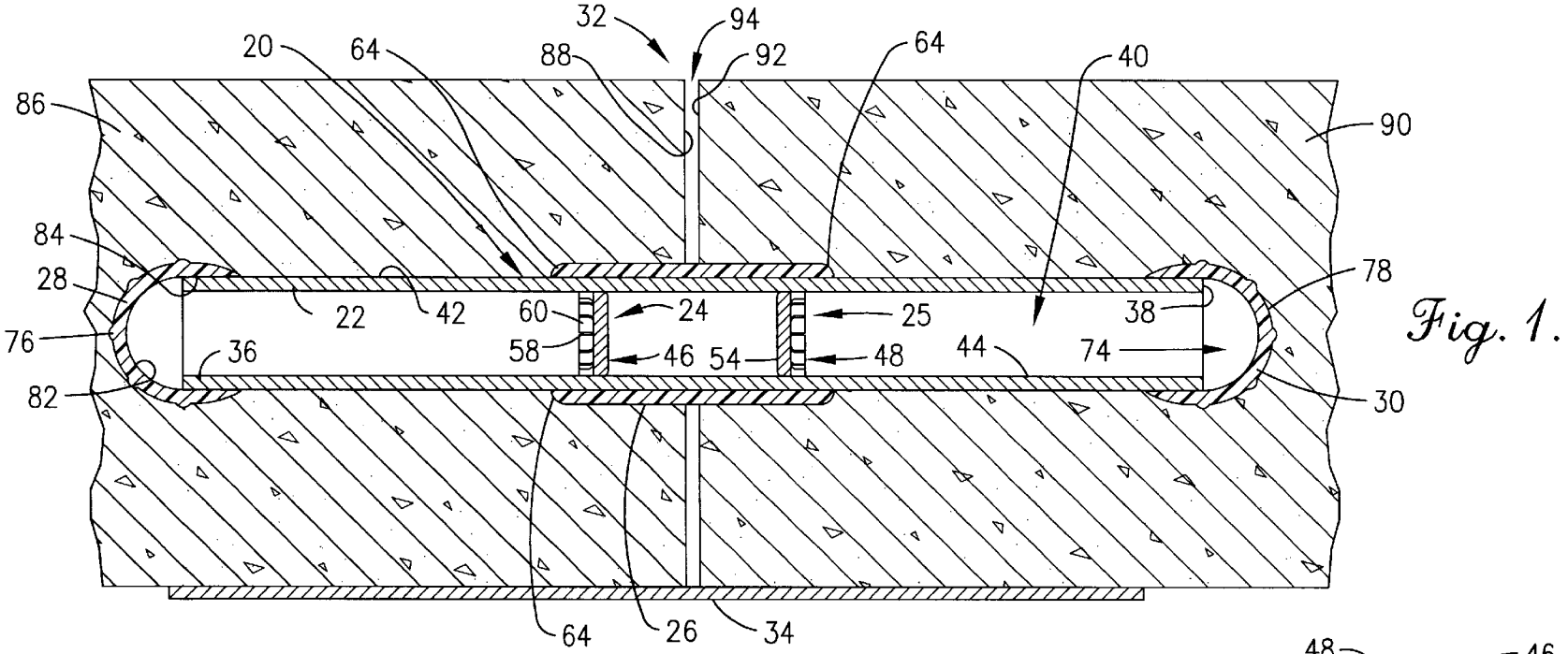
FIG. 1 is a transverse cross sectional view of an expansion joint assembly according to the present invention and including an expansion or crack joint coupler according to the present invention.

Turning now to the drawings, FIG. 1 depicts a preferred expansion or crack joint coupler 20 having a casing 22, internal structural components 24, 25, a reinforcing sleeve 26, and end caps 28, 30. The coupler 20 is part of an expansion or crack joint assembly 32. In a crack joint, there is no initial separation between slabs 86, 90, but saw cuts are made in the top of a continuous concrete slab to induce cracks where the couplers 20 are located. A bottom sheet 34 is used where local conditions make its use advisable.

In greater detail, the casing 22 is elongated between two ends 36, 38 having a center therebetween and defines an internal chamber 40 therein. The casing normally ranges in length from approximately 18 inches to approximately 20 inches, but the length is not critical. The casing is preferably a hollow tubular body and has a constant annular wall having an outer surface 42 and an inner surface 44 with a preferred inner diameter of approximately 1.5 inches. Thus, the internal chamber is essentially cylindrical. The preferred casing material is structural steel. Therefore, the casing is preferably a standard size of extra strong steel pipe.

Figure 4:
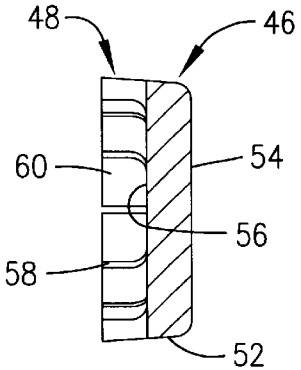
FIG. 4 is a cross sectional view of the internal structural component of FIG. 3 having a tapered feature thereof exaggerated for illustrative purposes.
Figure 3:
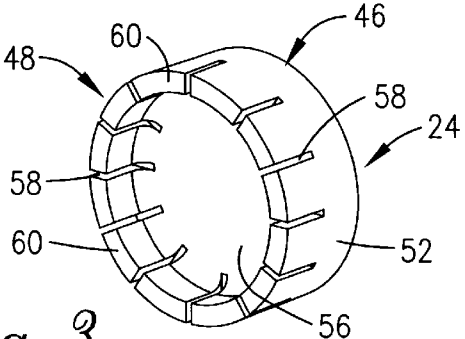
FIG. 3 is a perspective view of an internal structural component of the expansion or crack joint coupler of FIG. 1.

Referring additionally to FIGS. 3 and 4, the internal structural components 24, 25 are preferably identical and comprise tapered spring disks. Each tapered spring disk 24 includes a substantially rigid portion 46 and an integral, compressible portion 48. The disk 24 is substantially circular but its outer annular surface 52 tapers slightly inward from the rigid portion 46 to the compressible portion 48.

The rigid portion 46 is solid and has a smallest outer diameter approximately equal to the inner diameter of the casing. The rigid portion has an inner side 54, and an outer side 56. The rigid portion forms a base for the compressible portion.

The compressible portion 48 is an annular ring, and the outer diameter of the compressible portion is slightly larger than the inner diameter of the casing 22. Thus, the compressible portion outer diameter is generally larger than the smaller rigid portion outer diameter. The compressible portion defines a plurality of slits 58 substantially evenly spaced around the circumference of the compressible portion. The slits 58 form spring tabs 60 extending from the outer side 56 of the rigid portion 46 to form a cup shape.

The spring disks 24, 25 are positioned inside the internal chamber 40 on opposite sides of the casing center with the outer sides 56 facing the ends 36, 38 of the casing and with the inner sides 54 facing each other. The spring disks are preferably positioned equal distances of approximately 1.5 inches from the casing center.

Figure 5:
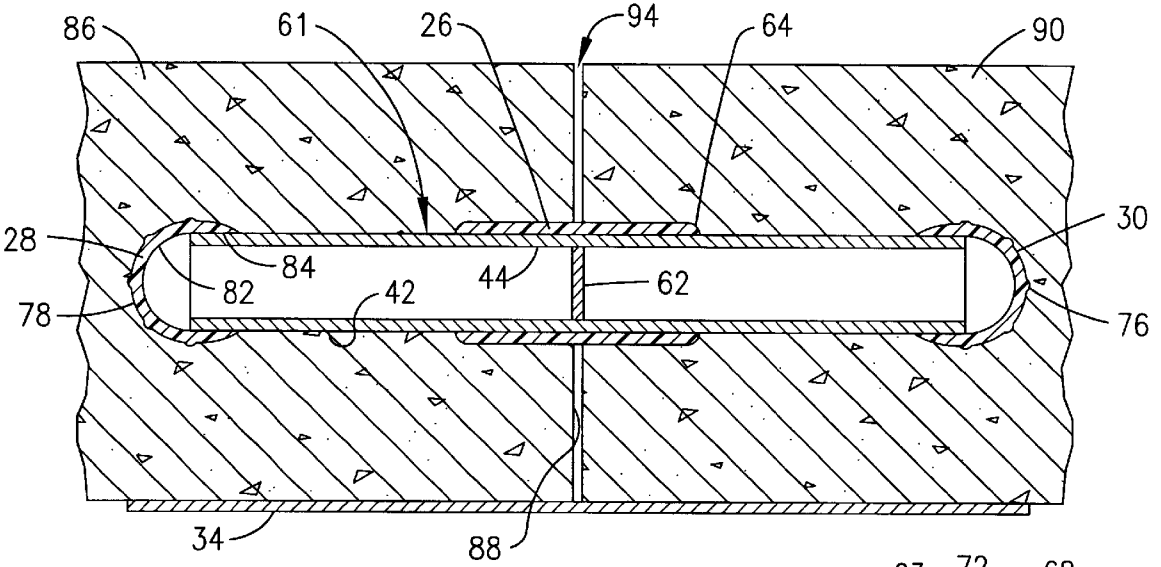
FIG. 5 is a transverse cross sectional view of an alternate expansion or crack joint coupler according to the present invention.

Referring to FIG. 5, in an alternate embodiment, a coupler 61 has an internal structural component which comprises a single circular disk 62 positioned substantially centrally in the casing 22. The circular disk 62 is preferably flat and sized to fit tightly in the casing.

Figure 6:
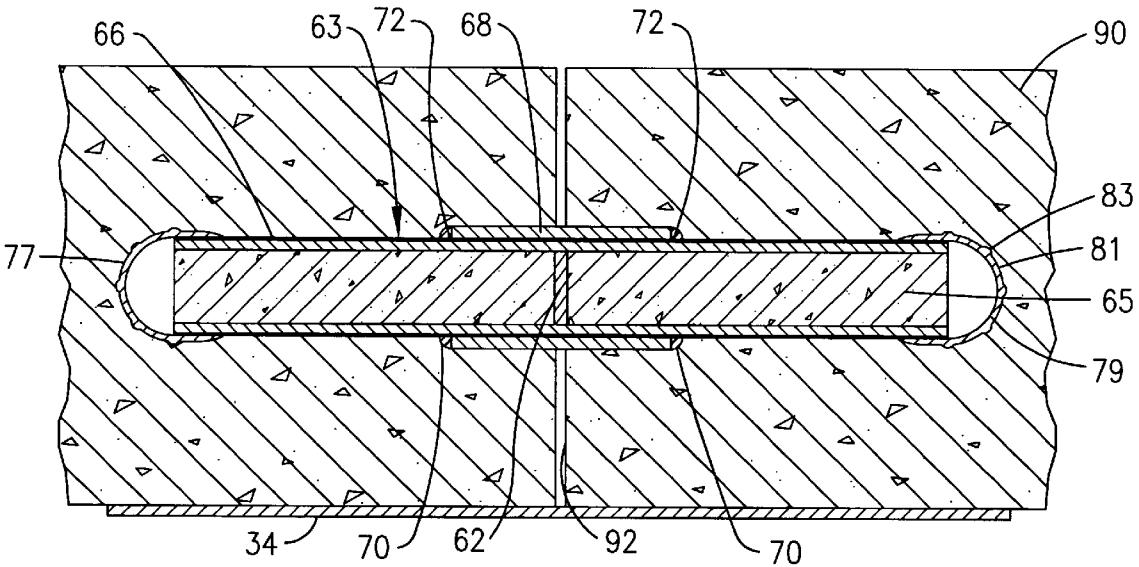
FIG. 6 is a transverse cross sectional view of another alternate expansion or crack joint coupler according to the present invention and having an adhesive coating thereof enlarged for illustrative purposes.

Referring to FIG. 6, in another alternate embodiment, a coupler 63 has an internal structural component which comprises a structural material 65 filling the internal chamber. The preferred structural material is concrete. The concrete can fill substantially the entire internal chamber 40 or it can fill in around the circular disk 62.

Referring to FIG. 1, the reinforcing sleeve 26 is preferably cylindrical and is sized to slide over the outer surface of the casing 22. Thus, the sleeve inner and outer diameters are larger than the casing outer diameter. The sleeve 26 has a sleeve length of approximately 5 inches and is thus shorter than the casing length. The sleeve is substantially centrally positioned around the casing, and the annular wall of the sleeve is preferably of constant diameter. The butt ends 64 of the sleeve are preferably rounded, and the sleeve material is preferably softer than the casing material. The preferred sleeve material is PVC. Referring additionally to FIG. 6, the sleeve is preferably fixed in a central position by an anti-corrosion adhesive coating 66 on the outer surface 42 of the casing.

FIG. 6 also shows an alternate reinforcing sleeve 68 which is preferably made from structural steel. Because of its strength, the steel sleeve thickness is less than the PVC sleeve thickness. When the steel sleeve is used, rounded end rings 70 are positioned around the casing 22 and abut the opposite ends of the steel sleeve 68. The upper, outer corners 72 of the end rings 70 are rounded, and the rings 70 are made with a ring material preferably softer than the steel sleeve and casing materials. The ring material is preferably rubber or PVC. The adhesive coating 66 also fixes the end rings 70 in position next to the opposite ends of the steel sleeve 68.

Figure 2:
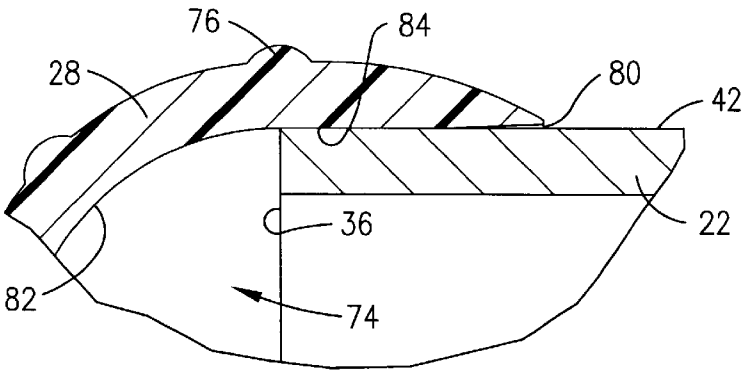
FIG. 2 is a fragmentary, enlarged, cross sectional view of an end cap of the expansion or crack joint coupler of FIG. 1.

Referring to FIGS. 1 and 2, the end caps 28, 30, which are arcuate in cross-section, each define an end cap opening 74 and are formed with or without concrete gripping bumps 76 on an outer surface 78 thereof. The end cap material is a synthetic resin material, preferably PVC which is softer than the casing material, and the end caps substantially close and seal the ends 36, 38 of the casing 22 to keep moisture out of the casing.

The end cap openings 74 are sized to frictionally couple to and cover the ends of the casing 36, 38. To that end, the openings 74 are slightly smaller than the casing outer diameter. However, the openings have a widening mouth 80 (FIG. 2), which is defined by an arcuately tapered circumferential edge and has a diameter slightly greater than the casing outer diameter to aide in assembly. The openings 74 have arcuate sections 82, which are, for example, parabolic or hemispherical in shape. The openings also have substantially straight walled sections 84 which extend approximately 1 inch over the ends of the casing.

The end cap has an integrally formed closed end body with an open mouth section and a closed endmost section which is arcuate in cross-section. The mouth section and endmost section are defined by an inner surface presenting an inner mouth segment and a closed, concave segment, and an outer surface presenting an outer mouth segment and a convex segment. The inner mouth segment is an elongated, substantially circular in cross-section surface, and the mouth is adapted to receive the end of an expansion joint force transmission member therein. The convex segment surface presents a series of outwardly extending, arcuate in cross-section projections whic comprise the bumps 76. The outer mouth segment preferably tapers from the convex segment to the outer edge of the inner mouth segment. The concave segment extends from the inner mouth segment and defines a hollow region within the end cap.

If used, the gripping bumps 76 are evenly spaced over the outer surface 78, which preferably is generally frustospherical, of the caps and are preferably arranged in a symmetrical pattern. The bumps are preferably integrally formed with the caps. Alternatively, the outer surfaces 78 of the caps are smooth.

Referring to FIG. 6, the end cap material can also be steel. The steel end caps 77, 79 are configured similarly to the PVC end caps 28, 30, but because of their higher strength, the steel end caps 77, 79 are thinner. The outer surface 81 of the steel end caps 77, 79 can have gripping bumps 83 or be smooth.

Referring again to FIG. 1, the expansion or crack joint assembly 32 connects a first concrete slab 86 having a first end 88 and a second concrete slab 90 having a second end 92. The first concrete slab is adjacent the second concrete slab, so that the first end 88 and the second end 92 are positioned to face each other with a narrow expansion gap 94 therebetween. The gap 94, which has been enlarged for illustration, can be filled with an expandable material or component (not shown) if desired.

In a crack joint, the gap 94 does not exist, but a saw cut is made in the top of the slab. The couplers for crack joints are put in place before continuous casting of PCC pavement in which cracks are induced by saw cuts in the previously continuous concrete slabs at locations of previously placed rows of couplers. The cuts induce cracks which propagate from the bottom of the cut to the bottom of the slab.

The bottom sheet 34, when used, is positioned beneath the concrete slabs 86, 90 and has a width sufficient to cover the gap 94 between the slabs. The sheet is placed on the subgrade before the concrete is cast. The purpose of the sheet 34 is to reduce pumping. The sheet is preferably 18 inches wide, and is substantially impenetrable to water. The coupler 20 is configured for embedment in the concrete slabs 86, 90 and extends across the expansion gap 94 or the cracked joint which will develop under the saw cut.

The expansion or crack joint coupler 20 is preferably assembled and then transported to construction sites. To assemble the coupler shown in FIG. 1, the casing is cut to length, and the adhesive coating 66 (FIG. 6) is applied. Before the adhesive coating cures the sleeve 26 is positioned over the central region of the casing. Once the adhesive is cured, the sleeve 26 is fixed in place. Before or after the sleeve is positioned, the spring disks 24, 25 are pressed into the internal chamber. The rigid portions 46 are sized to slide through the internal chamber, preferably with some friction, and the compressible portions 48 are sized to compress the spring tabs inwardly when forced into the internal chamber. Thus, the compressible portions 48 hold the spring disks in place. The mouths 80 of the end caps 28, 30 are aligned with the ends 36, 38 of the casing 22 and press fit over the casing and adhesive coating.

The assembly of the alternate coupler 61 shown in FIG. 5 is similar to that of the coupler 20 shown in FIG. 1 with the exception that only the single circular disk 62 is pressed into the casing. The assembly of the coupler 63 shown in FIG. 6 is also similar except that the end rings 70 are also positioned before the adhesive cures, and the concrete is poured into the internal chamber 40 and cured before the end caps 77, 79 are put in place.

In the completed expansion or crack joint assembly 32, the casing and sleeve transmit forces between the concrete slabs. Thus, the casing and sleeve act as elongated force transmission members bridging the expansion or crack joint and having two opposed ends. The spring disks 24, 25 maintain the casing's cylindrical shape under bending loads, so that the coupler is stiffer allowing the casing to transmit such loads with increased efficiency. Thus, there is less relative bending between adjacent concrete slabs. Because the spring disks are spaced apart, the positioning of the casing center relative to the gap 94 is not critical. The stress concentrations that normally occur in the center of the coupler are minimized by the increased diameter of the casing 22 and the PVC sleeve 26. That is, the coupler has a larger bearing area, and thus, the bearing stress is less. The softer sleeve material also minimizes stress by compressing slightly and dampening vibrations thereby avoiding stress fractures in the concrete.

The rounded ends 64 of the sleeve 26 prevent a stress concentration at the ends as would occur at a sharp edge. The sleeve 26 also protects the adhesive coating 66 (FIG. 6), which preferably inhibits corrosion.

The end caps 28, 30 protect the adhesive coating 66 on the ends of the casing 22. The end caps also minimize stress concentrations at the ends 36, 38 of the casing because they are arcuate and are made from a relatively soft end cap material. The flexibility of the PVC end caps also reduces compressive thermal stress. The PVC sleeve and end caps also allow small angular deformation of the concrete to further alleviating thermal stress, and both the sleeve and end caps operate to reinforce the respective portions of the casing. The concrete gripping bumps 76 operate to fix the end caps in the concrete slabs.

The bottom sheet 34 seals against the bottoms of the slabs to inhibit water from entering the expansion or crack joint through the expansion joint gap 94, or the cracks formed under saw cuts. Specifically, the sheet 34 keeps the gap from acting as a pump as the gap repeatedly narrows and widens due to the expansion and contraction of the concrete slabs and as differential motion and deflation of adjacent slabs occurs under loading.

The coupler 61 of FIG. 5 operates similarly. However, the coupler 61 is less expensive because only the simpler to manufacture, single circular disk 62 is used. Both the couplers 20, 61 of FIGS. 1 and 5 respectively provide approximately 150% of the strength of standard size, solid steel dowels, and because the couplers 20, 61 of FIGS. 1 and 5 are substantially hollow, they weigh approximately 75% less than standard size, solid steel dowels. Thus, they are much less expensive to ship to construction sites. Further, these couplers are significantly stiffer than standard solid dowels.

The coupler 63 of FIG. 6 also operates similarly, but provides further increased strength and stiffness. The concrete filled coupler 63 with the increased reinforcement from the steel end caps 77, 79 and the steel sleeve 68 provides approximately 200% greater strength than the standard size, solid steel dowel and is approximately 300% stiffer. The end rings 70 operate to alleviate stress concentrations at the ends of the sleeve 68.

The coupler 20 having the spring disks and a coupler filled with concrete according to the present invention were subjected to bending and shearing tests. The same tests were performed on a solid steel dowel, a solid glass fiber epoxy dowel, and a glass fiber tube filled with concrete. The results of the tests are set forth below in table format for comparison. Table 1 shows the average results of the bending test, and Table 2 shows the average results of the shearing test.

TABLE 1

| | Deflection in 0.001 inch | | | | |
|---|---|---|---|---|---|
| Load (Kips) | Steel Pipe Coupler with Two Disks | Steel Pipe Coupler with Concrete | Solid Steel Dowel | Solid Glass Fiber | Glass Fiber with Concrete |
| 1 | 10.75 | 13.75 | 266.5 | 53 | 104.5 |
| 2 | 21.25 | 26 | 50.75 | 104.67 | 194.5 |
| 3 | 31.5 | 36 | 72.5 | 147.33 | 276 |
| 4 | 39.5 | 47 | 95.5 | 186 | 367.5 |
| 5 | 46.5 | 55.75 | 119.5 | 219 | 424.5 |
| 6 | 54.25 | 64.75 | 159.25 | 249.67 | 484 |
| 7 | 65.75 | 73.5 | 213.75 | 276.67 | 541 |
| 8 | 88.75 | 82.5 | 273.5 | 300.67 | 596 |
| 9 | 129.25 | 94.75 | 338.75 | 325.67 | 667 |
| 10 | 170.5 | 111 | 399.25 | 347.67 | 723 |
| 11 | 208 | 132 | 467.75 | 371 | 810 |
| 12 | 248.75 | 154.25 | | | 907.5 |
| 13 | 283.75 | 174.75 | | | |
| 14 | 320.75 | 195.75 | | | |
| 15 | 363.75 | 217.25 | | | |
| 16 | | 240.25 | | | |
| 17 | | 265.5 | | | |
| 18 | | 300.75 | | | |
| 19 | | 330.25 | | | |
| 20 | | 366 | | | |

TABLE 2

| | Deflection in 0.001 inch | | | |
|---|---|---|---|---|
| Load (Kips) | Steel Pipe Coupler with Disks | Solid Steel Dowel | Solid Glass Fiber | Glass Fiber with Concrete |
| 5 | 31.25 | 43 | 47 | 53.5 |
| 10 | 53.5 | 71.5 | 76.5 | 88 |
| 15 | 85.25 | 92 | 94 | 111.5 |
| 20 | 119 | 113.5 | 127 | 129 |
| 25 | 146.5 | 132.5 | 159 | 145.5 |
| 30 | 174.5 | 149.5 | | 166 |

Thus the couplers of the present invention provide increased strength and stiffness while minimizing stress concentrations. Thus, the deterioration of expansion or crack joint assemblies is substantially decreased.

We claim:

1. A combination comprising:

a pair of adjacent concrete slabs cooperatively having an elongated expansion joint therebetween; and an expansion joint coupler embedded in both of said slabs and extending across said expansion joint, said coupler includinga casing defining an internal chamber therein, with an internal structural component positioned in said chamber to stiffen and strengthen the casing, said component comprising a fill material substantially filling said chamber, said fill material comprising concrete; and a pair of end caps coupled with and substantially closing ends of the casing.

2. The combination of claim 1, said casing comprising a tubular metallic pipe.

3. The combination of claim 1, said structural component further comprising a disk within said internal chamber.

4. The combination of claim 3, said disk being positioned near a casing center.

5. The combination of claim 3, said disk comprising a spring disk including a substantially rigid smaller diameter portion and a compressible larger diameter portion.

6. The combination of claim 1, said end caps being arcuate in cross-sectional configuration.

7. The combination of claim 1, each of said end caps including a plurality of spaced apart arcuate gripping bumps on the outer surfaces thereof.

8. The combination of claim 1, including an outer reinforcing sleeve positioned about said casing between said end caps.

9. A combination comprising:

a pair of adjacent concrete slabs cooperatively having an elongated expansion joint therebetween; and an expansion joint coupler embedded in both of said slabs and extending across said expansion joint, said coupler includingan elongated metallic body formed from steel pipe and having a length sufficient to span said joint and a pair of opposed ends, with each end within one of said adjacent concrete slabs and outer surface areas of the body in contact with said concrete;

a pair of end caps, one end cap of said pair coupled to each of said opposed ends, with each of the caps embedded within one of said adjacent concrete slabs and spaced from said joint, each of said end caps having a mouth section presenting an inner surface in frictional locking contact with one of said opposed ends, and an endmost section presenting a convex outer surface which is arcuate in longitudinal cross-section.

10. The combination of claim 9, said pipe at least partially filled with concrete.

11. The combination of claim 9, including a structural component with said pipe.

12. The combination of claim 11, said component comprising a spring disk.

13. The combination of claim 9, said end caps formed of synthetic resin material.

14. The combination of claim 9, said outer surface of each end cap having a series of spaced apart, outwardly extending projections.

15. The combination of claim 9, including an outer reinforcing sleeve positioned about said body between said end caps.

16. The combination of claim 15, said sleeve extending across said joint.

17. The combination of claim 15, said sleeve adhesively secured to said body.

18. The combination of claim 9, said body being generally rectilinear along the length thereof.

19. A combination comprising:

a pair of adjacent concrete slabs cooperatively having an elongated expansion joint therebetween; and an expansion joint coupler embedded in both of said slabs and extending across said expansion joint, said coupler includinga casing defining an internal chamber therein, with an internal structural component positioned in said chamber to stiffen and strengthen the casing, said component comprising a fill material substantially filling said chamber and a disk within said chamber; and a pair of end caps coupled with and substantially closing ends of the casing.

20. The combination of claim 19, said disk being positioned near a casing center.

21. The combination of claim 19, said disk comprising a spring disk including a substantially rigid smaller diameter portion and a compressible larger diameter portion.

22. A combination comprising:

a pair of adjacent concrete slabs cooperatively having an elongated expansion joint therebetween; and an expansion joint coupler embedded in both of said slabs and extending across said expansion joint, said coupler includinga casing formed from steel pipe and defining an internal chanter therein, with an internal structural component positioned in said chamber to stiffen and strengthen the casing, said component comprising a fill material substantially filling said chamber, outer surfaces of said casing being in contact with said concrete; and a pair of end caps frictionally locked with and substantially closing ends of the casing, said end caps presenting outer surfaces which are arcuate in longitudinal cross-section.

23. A combination comprising:

a pair of adjacent concrete slabs cooperatively having an elongated expansion joint therebetween; and an expansion joint coupler embedded in both of said slabs and extending across said expansion joint, said coupler includinga casing defining an internal chamber therein, with an internal structural component positioned in said chamber to stiffen and strengthen the casing, said component comprising a fill material substantially filling said chamber; and a pair of end caps coupled with and substantially closing ends of the casing, each of said end caps including a plurality of spaced apart arcuate gripping bumps on the outer surfaces thereof.

* * * * *